US006286662B1

(12) United States Patent
Meier

(10) Patent No.: US 6,286,662 B1
(45) Date of Patent: Sep. 11, 2001

(54) CLAMP FOR HOLDING SHEET-LIKE OBJECTS

(75) Inventor: Jacques Meier, Bäretswil (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 09/462,113

(22) PCT Filed: May 5, 1998

(86) PCT No.: PCT/CH98/00180

§ 371 Date: Jan. 27, 2000

§ 102(e) Date: Jan. 27, 2000

(87) PCT Pub. No.: WO99/01367

PCT Pub. Date: Jan. 14, 1999

(30) Foreign Application Priority Data

Jul. 3, 1997 (CH) ..... 1613/97

(51) Int. Cl.[7] ..... B65G 25/00

(52) U.S. Cl. ..... 198/803.9; 271/204; 294/99.1; 294/103.1

(58) Field of Search ..... 198/803.8, 803.9, 198/470.1; 271/204, 205; 294/99.1, 103.1

(56) References Cited

U.S. PATENT DOCUMENTS

| | | | | |
|---|---|---|---|---|
| 2,716,910 | * | 9/1955 | Guerinet | 294/103.1 |
| 3,662,875 | * | 5/1972 | Salomon | 198/803.9 |
| 3,948,551 | | 4/1976 | Reist . | |
| 3,986,745 | * | 10/1976 | Langguth | 294/103.1 |
| 4,007,824 | * | 2/1977 | Reist | 198/803.9 |
| 4,036,356 | | 7/1977 | Reist . | |
| 5,489,093 | | 2/1996 | Morehead, III . | |

FOREIGN PATENT DOCUMENTS

| | | |
|---|---|---|
| 569 197 | 11/1975 | (CH) . |
| 552 330 | 6/1932 | (DE) . |
| 23 03 424 | 8/1974 | (DE) . |
| 0 643 001 | 3/1995 | (EP) . |
| 1 123 381 | 8/1968 | (GB) . |
| WO 98/03420 | 1/1998 | (WO) . |
| WO 98/03421 | 1/1998 | (WO) . |

* cited by examiner

*Primary Examiner*—Joseph E. Valenza
(74) *Attorney, Agent, or Firm*—Alston & Bird LLP

(57) ABSTRACT

The invention relates to a clamp (10) for holding sheet-like objects, having a support (12) on which a clamp tongue (20) is fixed. A clamping jaw (32) is stored in a guide slot (30) in the support (12) in such a way that it can move both in and against the direction of closing (S). When the clamping jaw (32) moves from open position (34) in closing direction (S), the clamp end (42) is displaced along the path of movement (46), until it rests against the clamp tongue (20) or an adjacent object. As the clamping jaw (32) continues to move in closing direction (S), the clamp end is driven back from the path of movement (46), and a clamping force for holding the object is formed as a result of the elasticity of the clamping jaw (32).

10 Claims, 4 Drawing Sheets

Fig.1
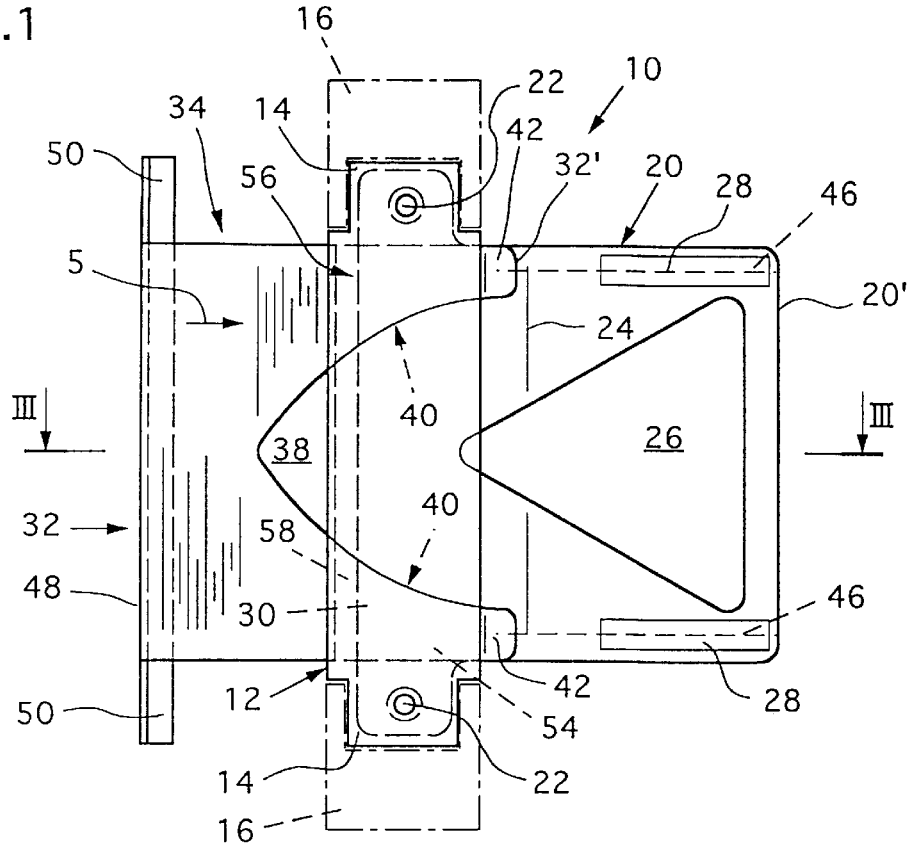
Fig.2
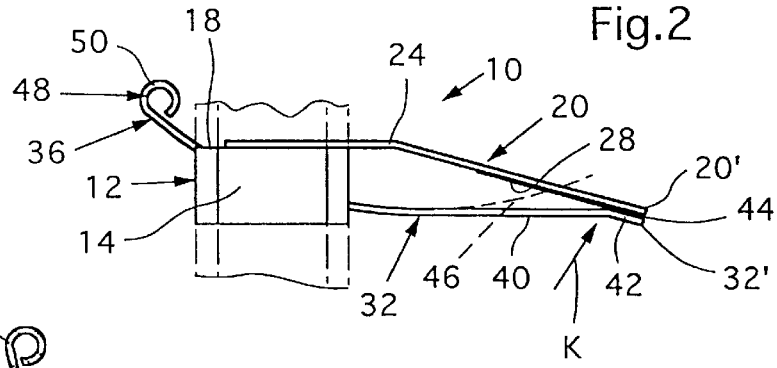
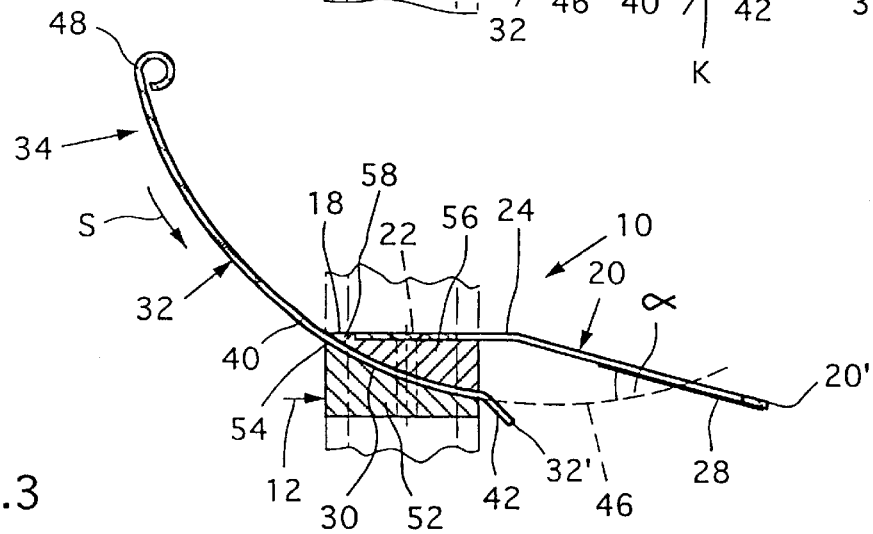
Fig.3

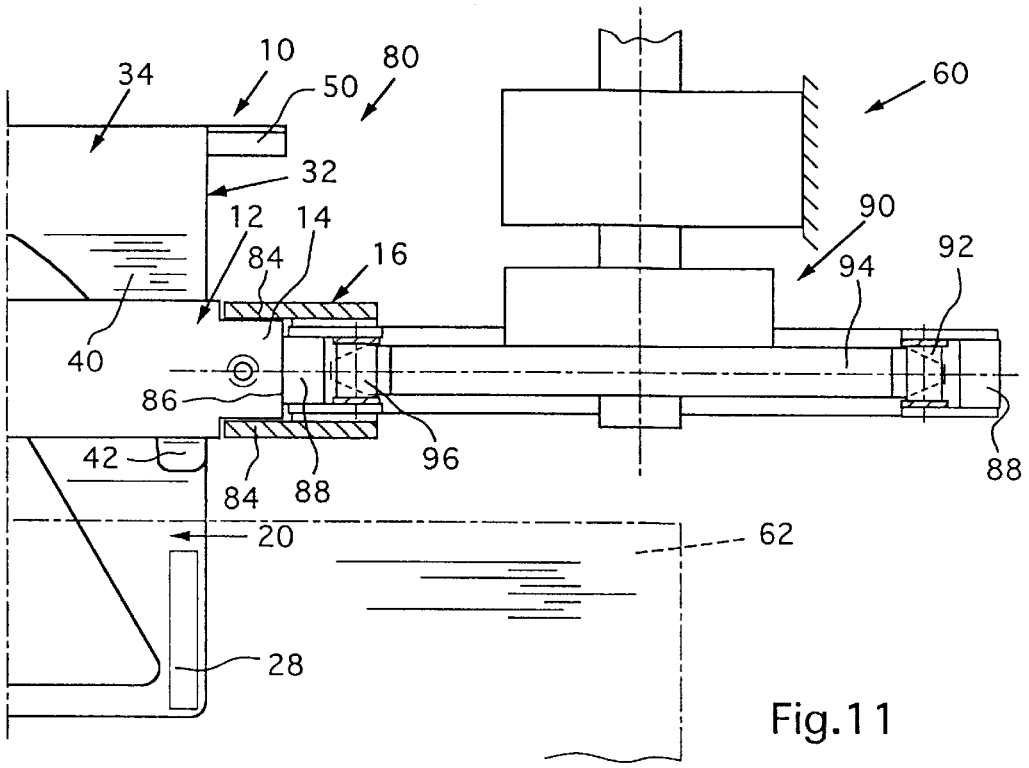
Fig.11
Fig.12
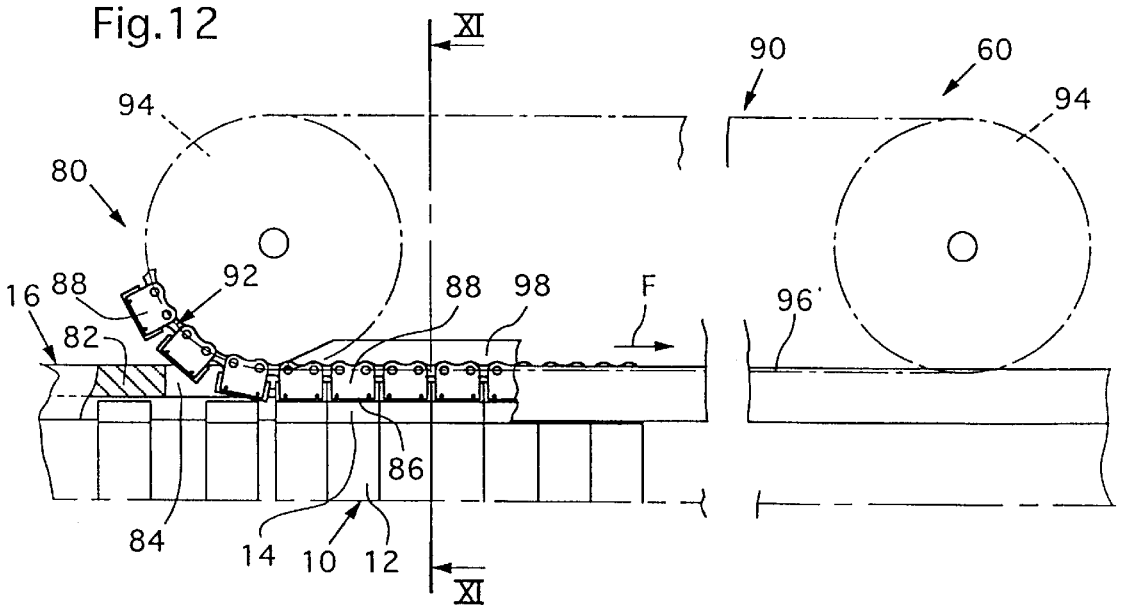

CLAMP FOR HOLDING SHEET-LIKE OBJECTS

BACKGROUND OF THE INVENTION

The present invention relates to a clamp for holding flat objects as they move along a path travel.

A clamp of the generic type, designed in the manner of a pair of tongs, is disclosed in Swiss Patent No. 569 197 and in the corresponding U.S. Pat. No. 3,948,551. It has a clamping tongue which is permanently arranged on a holding part. A clamping jaw can be pivoted about an axis extending at right angles to the clamping tongue, from an open position into a clamping position, in which it forms a clamping gap with the clamping tongue. The clamping tongue and the clamping jaw can be moved relative to each other in the extent of the clamping gap, away from each other in the open position and toward each other into their clamping position. This makes it necessary for the clamp to be rotated through 90° out of and into the area defined by the object during the opening and closing operations. Simultaneous rotation of the entire clamp and the movement of the clamping jaw relative to the clamping tongue are therefore necessary which, in addition to the space requirement during gripping and releasing an object, requires complicated control. On the other hand, this known clamp has particular advantages. It is self-locking and self-retaining, it adds virtually nothing to the thickness of the flat objects and there is consequently space for it both in an interleaved formation of the objects and in the case of buffering or stacking of the objects—with a virtually constant space requirement. Furthermore, it has such a low weight that, when necessary, it can be carried and held by the object itself.

It is an object of the present invention to provide a clamp of the generic type which, while maintaining the advantages of the known clamp, is simpler to handle.

SUMMARY OF THE INVENTION

The above and other objects and advantages of the present invention are achieved by the provision of a clamp which comprises a supporting part, a clamping tongue fixed to the supporting part, a clamping jaw moveably mounted on the supporting part for movement between an open position separated from the clamping tongue and a clamping position in which a free end of the clamping jaw forms with the clamping tongue a clamping gap adapted to engage and hold a flat article therebetween, and wherein during movement from the open position toward the clamping position, the free end of the clamping jaw moves along a movement path which forms an acute angle with the clamping tongue and during continued movement after encountering an article resting on the clamping tongue the clamping jaw is resiliently deflected out of the path of movement in a direction transverse to the clamping tongue so as to produce a clamping force on the article.

Rotating the clamp according to the invention during opening and closing is no longer necessary. It is simple in construction, inexpensive to produce and extremely simple to handle. Furthermore, the clamping jaw is held in the clamping position by self-locking; locking elements are not needed. The slim construction of the clamp enables the buffering of the objects held by the clamp in the smallest possible space, while maintaining the separation of the objects; that is to say each object is gripped individually and can thus be handled individually. Furthermore, the clamp can be opened when adjacent clamps are resting on one another in a buffer.

BRIEF DESCRIPTION OF THE DRAWINGS

The invention will now be explained in more detail with reference to an exemplary embodiment illustrated in the drawing, in which, in purely schematic form:

FIG. 1 shows, in plan view, a clamp according to the invention in the open position;

FIG. 2 shows, in side view, the clamp shown in FIG. 1 in the closed position;

FIG. 3 shows, in a section along the line III—III in FIG. 1, the clamp shown there in the open position;

FIG. 11 shows, in plan view and partly sectioned along the line XI—XI of FIG. 12, a drive apparatus for the clamps; and FIG. 12 shows the drive apparatus shown in FIG. 11 in plan view.

DETAILED DESCRIPTION OF THE PREFERRED EMBODIMENT

Figure 6:
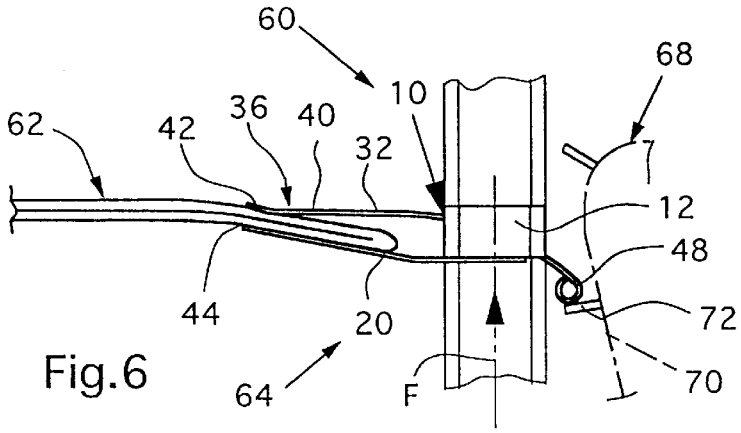
FIG. 6 shows, in an identical illustration to that in FIG. 5, the clamp shown there in the clamping position in order to hold the printed product.

The clamp 10 shown in FIGS. 1 to 3 has an essentially box-shaped supporting part 12. As viewed in the longitudinal direction of the supporting part 12, guide tabs 14 are integrally molded on its two ends and are intended to engage in the guide rails 16, which have a C-shaped cross section and are open toward each other. As a result, the clamp 10 can be displaced in a sliding manner in the guide rails 16.

On one side face 18 of the supporting part 12 there rests a flat, essentially rectangular, clamping tongue 20, which is fixed to the supporting part 12 by means of suitable fixing means 22, for example screws or rivets. The side face 18 lies in a plane extending at right angles to the longitudinal direction of the guide rails 16, so that the clamping tongue 20 projects transversely to the guide rails 16, beyond these and the supporting part 12, in the manner of a cantilever. As shown in particular by FIGS. 2 and 3, the clamping tongue 20 is bent about a bending line 24 extending parallel to the longitudinal direction of the supporting part 12, so that the free end 20' of the clamping tongue 20 lies approximately in a plane which is defined by that face of the supporting part 12 which has a rectangular cross section and which is located opposite the side face 18. In addition, the clamping tongue 20 has a triangular aperture 26 in its part projecting beyond the supporting part 12, in order to save weight. Adjacent to its free end 20', the clamping tongue 20 is provided with two adhesive covering strips 28 on its side which is located radially on the inside as viewed in relation to the bend.

The supporting part 12 has a guide gap 30, through which there passes a flat, essentially rectangular, bent clamping jaw 32. The latter can be moved from an open position 34, shown in FIGS. 1 and 3, into a clamping position 36, shown in FIG. 2, by being displaced in the closing direction S.

The clamping jaw 32 is bent in the manner of a segment of a circular cylinder about an axis extending parallel to the longitudinal direction of the supporting part 12, and is guided on the supporting part 12 in such a way that the clamping tongue 20 is located on the radially inner side of the clamping jaw 32. The guide gap 30 is shaped so as to correspond to the curvature of the clamping jaw 32.

From its free end 32', facing the clamping tongue 20, the clamping jaw 32 is provided with an approximately triangular cutout 38, by which means two clamping limbs 40 of the clamping jaw 32 are formed, which, at their end region adjacent to the free end 32', are bent over, in the direction opposite to the bending of the clamping jaw 32, to form a clamping foot 42. In clamping position 36, the clamping feet 42 form a clamping gap 44 with the clamping tongue 20.

In the open position 34, the clamping jaw 32 is located in a position in which the clamping feet 42 are located at the supporting part 12. When the clamping jaw 32 is moved from the open position 34 in the closing direction S, the clamping feet 42 move along a circular movement path 46 which intersects the clamping tongue 20 at an acute angle $\alpha$. The movement path 46 is a circular path, whose center is located on the axis of the bend in the clamping jaw 32 and whose radius corresponds to the distance from the axis to the clamping jaw 32. In the exemplary embodiment shown, the angle $\alpha$ is approximately 30°. However, it can also be smaller or larger; preferably, however, it is less than 45°.

When the clamp 10 is closed in the closing direction S, the clamping feet 42 move along their movement path 46 until they come to rest on the adhesive covering strip 28 or on a flat object resting on the clamping tongue 20. During onward movement in the direction of arrow S, the clamping feet 42 slide along the outer side, facing them, of the flat product or the adhesive covering strip 28 in the direction of the free end 20' of the clamping tongue 20, as a result of which the clamping feet 42 are deflected out of the movement path 46 which they would otherwise follow further. Since the clamping jaw 32 is produced from intrinsically resilient material, for example from spring-steel sheet, and is guided in the guide gap 30 so that it cannot give way transversely to the latter, the clamping feet 42 are forced back resiliently as a result, by which means a clamping force K is produced which presses the flat object onto the clamping tongue 20 and, in particular, the adhesive covering strips 28. Because of the acute angle a, no force component, or only a small force component, is able to act on the clamping jaw 32 counter to the closing direction S. This force component is readily absorbed by the frictional force in the guide gap 30, so that the clamp 10 is self-retaining in the clamping position 36.

At the end 48 opposite the clamping feet 42, the clamping jaw 32 is provided with lateral projections 50 and bent in the manner of a tube. The projections 50 are intended to interact with an opening element, in order to displace the clamping jaw 32 from the clamping position 36 into the open position 34, counter to the closing direction S.

The supporting part 12 comprises a supporting element 52 having a recess 54, into which there is inserted a wedge element 56, which engages with a retaining tab 58 behind the clamping tongue 20 and in this way is retained in the recess 54. The supporting element 52 and the wedge element 56 bound the guide gap 30.

Figure 5:
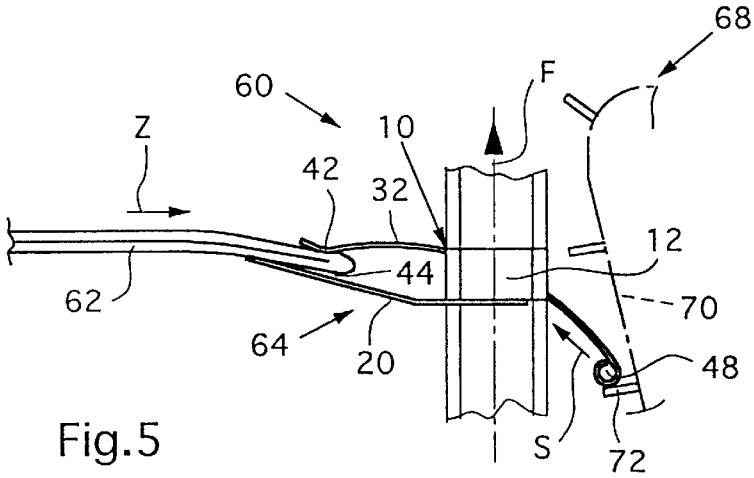
FIG. 5 shows, in an identical illustration to that in FIG. 4, the part of the apparatus shown there with a clamp during the closing operation.
Figure 4:
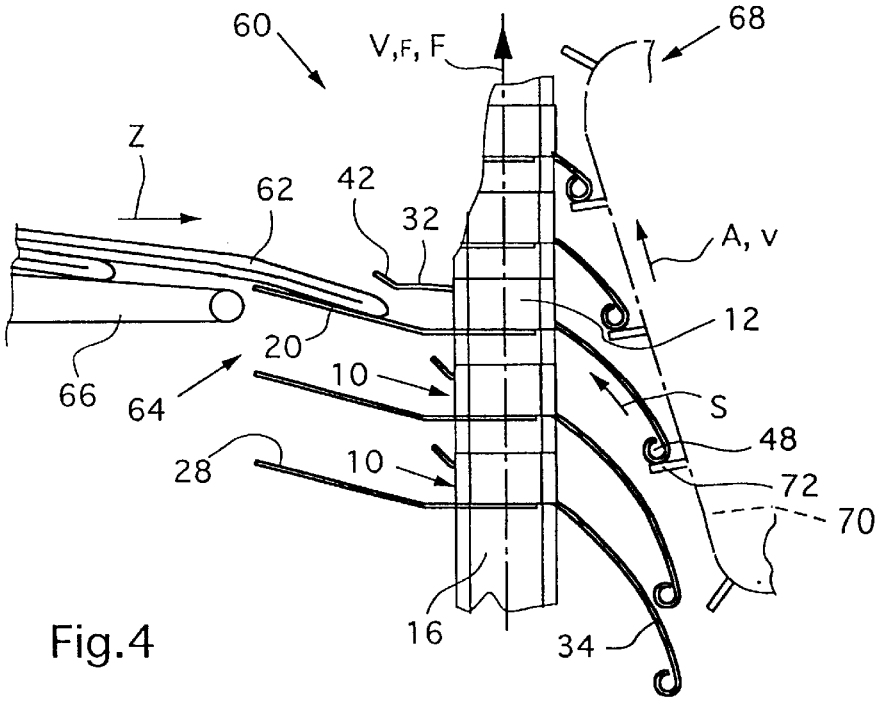
FIG. 4 shows, in side view, part of an apparatus having a large number of clamps according to FIGS. 1 to 3 arranged one behind another, a printed product being fed to each of the clamps.

FIGS. 4 to 6 show part of an apparatus 60 for processing printed products 62, such as newspapers, magazines and the like. A transfer section 64 is shown in which, by means of clamps 10, printed products 62 fed by a belt conveyor 66 are accepted for onward transport. In the transfer section 64, the guide rails 16 extend in the vertical direction and the clamps 10, which are arranged immediately one behind another and resting on one another, are moved continuously forward from bottom to top in a conveying direction F. As viewed in the conveying direction F, the clamping tongues 20 of the clamps 10 trail the clamping jaws 32. The free end 20' of the clamping tongues 20 faces the belt conveyor 66, which is intended to transport the printed products 62 in the feed direction Z in an interleaved formation, in which each printed product 62 rests on the subsequent one. On the side which is opposite the belt conveyor 66, as referred to the guide rails 16, there is arranged a closing apparatus 68 for the clamps 10. The latter has an endless flexible drive member 70, which is driven so as to circulate in the direction of arrow A at a speed v, which is greater than the speed $v_f$ at which the clamps 10 are moved. Arranged on the flexible drive member 70, at intervals one behind another, are cams 72 which are each intended to interact with the end 48 of one clamping jaw 32.

The feed speed of the belt conveyor 66 and the speed $v_f$ with which the clamps 10 are moved are coordinated with each other in such a way that each clamp 10 is fed a printed product 62. As emerges from FIG. 4, in each case one clamping tongue 20 engages under the printed product 62 projecting beyond the end of the belt conveyor 66 and lifts this end in conveying direction F. Approximately at the same instant as the relevant clamping tongue 20 touches the printed product 62, a cam 72 of the closing apparatus 68 strikes the end 48 of the relevant clamping jaw 32 and displaces the latter from the open position 34 in the closing direction S; this is as a result of the difference between the speed v of the cams 72 and the speed $v_f$ of the clamps 10.

FIG. 5 shows that instant during the closing operation of the clamp 10 at which the clamping foot 32 comes into contact with the printed product 62. Since, however, because of its inherent stability, the printed product 62 is not yet resting flat on the clamping tongue 20, said product can be pushed still further in the feed direction Z into the clamping mouth, until it is brought to rest on the adhesive covering strip 28 by the clamping foot 42. From this moment, during the onward movement of the clamping jaw 32 in the closing direction S, the clamping limb 40, which is lengthened in the process, is stressed in the manner of a leaf spring, as a result of which a clamping force builds up, with which the printed product 62 is held by the clamp 10 for onward transport, as shown in FIG. 6. It goes without saying that the adhesive action of the adhesive covering strips 28 on the printed product 62 is greater than the sliding friction between the clamping feet 42 and the printed product 62. If necessary, the clamping foot 42 can be provided with a sliding covering. As is further revealed by FIG. 6, the clamps 10 are in each case in the closed position 36 when they reach the end of the closing apparatus 68.

Figure 9:
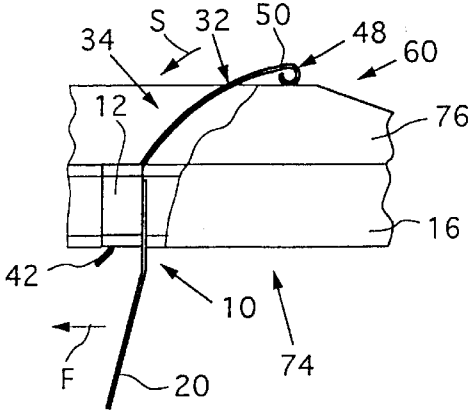
FIG. 9 shows, in an identical illustration to that in FIGS. 7 and 8, the clamp shown there in the open position.
Figure 8:
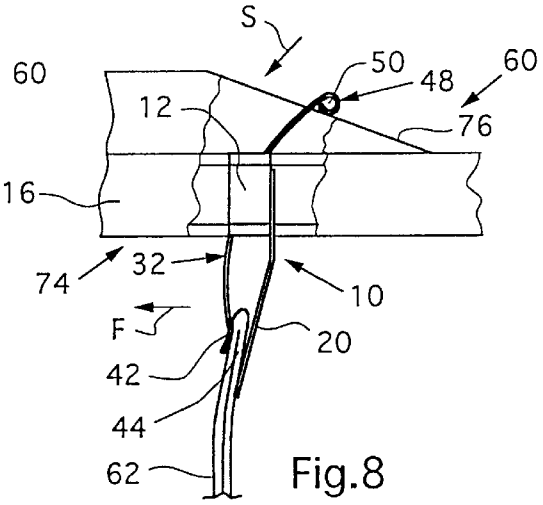
FIG. 8 shows the part shown in FIG. 7 of the apparatus with a partially opened clamp.
Figure 7:
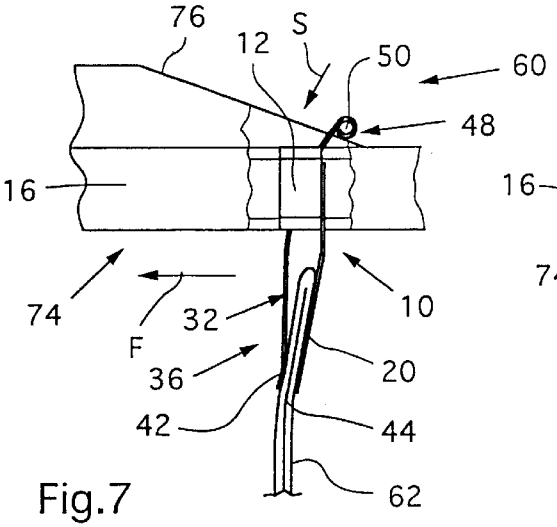
FIG. 7 shows a further part of the apparatus shown in FIGS. 4 to 6 with a clamp holding a printed product at the beginning of the opening operation.

FIGS. 7 to 9 show a further part, a discharge section 74, of the apparatus 60 already mentioned in conjunction with FIGS. 4 to 6. In the discharge section 74 shown, the guide rails 16 extend in the horizontal direction, and the clamps 10 are directed in the downward direction in order to transport the printed products 62 in a hanging position. The clamps 10 are moved in conveying direction F. As they enter the discharge section 74, the clamping jaws 32 are in the clamping position 36 and each hold a printed product 62 in the clamping gap 44 formed by them and the relevant clamping tongue 20. A wedge-shaped opening wing 76 is arranged on the two guide rails 16. In the course of the movement in conveying direction F, the two projections 50 of the relevant clamping jaw 32 come to rest on the opening wing 76 and, in the course of the onward movement of the clamp 10, are pulled in the opening direction, counter to the closing direction S. FIG. 7 shows the instant at which the projections 50 on a clamp 10 touch the opening wing 76. In the course of the onward movement, the clamping jaw 32 is pulled upward, as a result of which the clamping force K is reduced. FIG. 8 shows the instant at which the clamping foot 42 releases the printed product 62, so that the latter can be transferred downward to the next processing station. The clamping jaw 32 is subsequently moved completely into the open position 34, as FIG. 9 shows. The clamp 10 is ready to accommodate a printed product 62 again. The frictional relationships in the guide gap 30 are adequate to keep the clamping jaw 32 in the open position 34.

Figure 10:
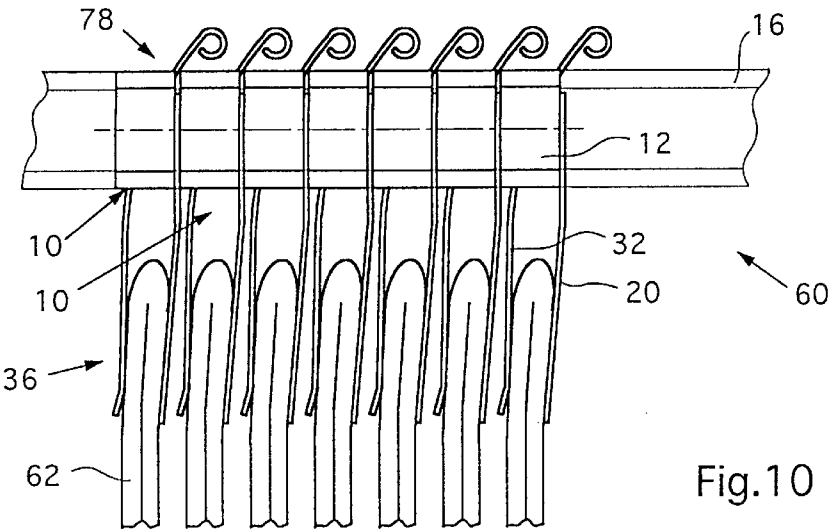
FIG. 10 shows a further part of the apparatus shown in FIGS. 4 to 9, having a large number of clamps arranged one behind one another, which each hold a printed product and rest on one another for the purpose of buffering.

FIG. 10 shows a buffer section 78 of the apparatus 60. This section is located, for example, between the transfer section 64 shown in FIGS. 4 to 6 and the discharge section 74 shown in FIGS. 7 to 9. In the buffer section 78, the guide rails 16 likewise extend in the horizontal direction and the clamps 10, each occupied by a printed product 62, rest on one another. This figure shows, in particular, that the clamps 10, as viewed in the longitudinal direction of the guide rails 16, are designed to be extremely slim, so that they add very little in comparison with the thickness of the printed products 62 which can be held by them. As a result, a high packing density can be achieved in the buffer section.

FIGS. 11 and 12 show a drive section 80 of the apparatus 60 in elevation and plan view. In the drive section 80, the bottom 82 of the guide rails 16, which have a C-shaped cross section, is removed. However, the lateral limbs 84 which are connected to each other by the bottom 82 in the other sections also extend continuously through the drive section 80, in order to guide the clamps 10. The supporting parts 12 of the clamps 10 engage with their guide tabs 14 in the guide rails 16, and their end faces 86 are intended to interact in the drive section 80 with driver elements 88 of a drive apparatus 90; a drive apparatus 90 is assigned to each guide rail 16. One of the drive apparatuses 90, which is of symmetrical construction and arrangement, will be described below. A large number of driver elements 88 are arranged on a chain 92, which is intrinsically closed and is guided around two sprockets 94 which have parallel axes and are spaced apart from each other in the direction of the guide rails 16. One of these sprockets 94 is driven so as to circulate in conveying direction F by means of a drive unit (not shown). The active conveying run 96 of the chain 92 extends parallel to the relevant guide rail 16 and, with respect to the latter, is arranged in such a way that the corresponding driver elements 88 engage between the limbs 84 in the guide rail 16 and rest with frictional contact on the end faces 86 of the supporting parts 12 of the clamps 10. A pressure and guide rail 98 arranged between the sprockets 94 ensures that the pressing force is maintained.

As can also be seen from FIG. 12, the clamps 10 can be moved freely in the guide rails 16 outside the drive apparatus 90, so that they can assume a different distance from one another.

A drive section 80 can overlap, for example, with a transfer section 64 or a discharge section 74 in order to move the clamps 10 in the conveying direction F in these sections.

It is also conceivable for the clamping jaws to be designed to be flat and for the clamping shoe 42 to be moved along a rectilinear movement path as the clamp is closed and opened. The movement path forms an acute angle with the clamping tongue in this case, too.

It is of course possible for the clamps 10 and for the apparatus 60 to be designed differently.

Clamps according to the invention are suitable, for example, for use in apparatuses such as are disclosed in WO Patent Applications PCT/CH97/00200 and PCT/CH97/00201.

Printed products 62 were mentioned as an example of flexible, flat objects in conjunction with the exemplary embodiment shown. However, the clamps 10 according to the invention are also suitable for holding stiff, flat objects or flat objects of different flexibilities.

The objects can have different thicknesses. In the exemplary embodiment shown, as the thickness increases, the clamping force K also becomes greater.

The clamping tongue can be of intrinsically resilient design and, for this purpose, can be produced from spring-steel sheet, for example. Finally, it would also be conceivable to design the clamping tongue to be resilient and the clamping jaw to be flexurally rigid.

What is claimed is:

1. A clamp for holding flat articles comprising a supporting part, a clamping tongue fixed to the supporting part, a clamping jaw moveably mounted on the supporting part for movement between an open position separated from the clamping tongue and a clamping position in which a free end of the clamping jaw forms with the clamping tongue a clamping gap adapted to engage and hold a flat article therebetween, and wherein during movement from the open position toward the clamping position, the free end of the clamping jaw moves along a movement path which forms an acute angle with the clamping tongue and during continued movement after encountering an article resting on the clamping tongue the clamping jaw is resiliently deflected out of the path of movement in a direction transverse to the clamping tongue so as to produce a clamping force on the article.

2. The clamp as defined in claim 1 wherein the clamping jaw is formed of an inherently resilient material.

3. The clamp as defined in claim 2 wherein the clamping tongue includes an adhesive-like surface on a side thereof facing the clamping jaw for engaging an article received thereon.

4. The clamp as defined in claim 2 wherein the acute angle is less than about 45 degrees.

5. The clamp as defined in claim 2 wherein the clamping tongue extends outwardly from the supporting part in a longitudinal direction, and wherein the movement of the clamping jaw between the open and clamping positions is along a generally longitudinal direction.

6. The clamp as defined in claim 5 wherein the clamping jaw is arcuately curved along its longitudinal length, and wherein the clamping tongue is positioned on the radially inner side of the clamping jaw.

7. The clamp as defined in claim 6 wherein the supporting part includes a guide gap which slideably receives the clamping jaw, and wherein the guide gap has a curvature which corresponds to the curvature of the clamping jaw.

8. The clamp as defined in claim 6 wherein the free end of the clamping jaw is bent to form a clamping foot.

9. The clamp as defined in claim 6 wherein the clamping tongue and the clamping jaw are each formed of a sheet material.

10. An article transport apparatus comprising a plurality of clamps for holding flat articles, with each clamp comprising a supporting part, a clamping tongue fixed to the supporting part, a clamping jaw moveably mounted on the supporting part for movement between an open position separated from the clamping tongue and a clamping position in which a free end of the clamping jaw forms with the clamping tongue a clamping gap adapted to engage and hold a flat article therebetween, and wherein during movement from the open position toward the clamping position, the free end of the clamping jaw moves along a movement path which forms an acute angle with the clamping tongue and during continued movement after encountering an article resting on the clamping tongue the clamping jaw is resiliently deflected out of the path of movement in a direction transverse to the clamping tongue so as to produce a clamping force on the article, a guide rail for supporting the clamps for movement along a path of travel, a delivery conveyor for delivering an article onto the clamping tongue of each of the clamps as the clamps move past a transfer location along the path of travel, and while the clamping jaws are in the open position, a closing device positioned along the path of travel immediately downstream of the transfer location for moving the clamping jaw of each of the clamps to its clamping position and so that the articles are engaged and held between the clamping tongue and the clamping jaw of the associated clamp, and a discharge device mounted along the path of travel downstream of the closing device for moving the clamping jaw of each of the clamps to its open position so as to release the article therefrom.

* * * * *